United States Patent [19]

Hatzinicolaides et al.

[11] 4,200,453

[45] Apr. 29, 1980

[54] PROCESS FOR THE PRODUCTION OF NICKEL ALLOYS

[75] Inventors: John A. Hatzinicolaides; Demetrios C. Papamantellos, both of Athens, Greece

[73] Assignees: Larco, Societe Miniere et Metallurgique de Larymna S.A., Athens, Greece; Eisenwerk-Gesellschaft Maximilianshutte m.b.H., Rosenberg, Fed. Rep. of Germany

[21] Appl. No.: 944,080

[22] Filed: Sep. 20, 1978

[30] Foreign Application Priority Data

Oct. 29, 1977 [GR] Greece ..... 54662

[51] Int. Cl.[2] ..... C21C 5/34

[52] U.S. Cl. ..... 75/52; 75/60; 75/82; 75/129

[58] Field of Search ..... 75/52, 60, 82, 129, 75/130 R

[56] References Cited

U.S. PATENT DOCUMENTS

| | | | |
|---|---|---|---|
| 3,771,998 | 11/1973 | Knuppel | 75/52 |
| 3,909,245 | 9/1975 | Brotzmann | 75/60 |

*Primary Examiner*—P. D. Rosenberg

*Attorney, Agent, or Firm*—Haseltine, Lake & Waters

[57] ABSTRACT

The process for production of a nickel alloy having a maximum sulphur content of 0.05% in a converter by treatment of a crude ferro-nickel melt having a sulphur content of about 0.10% to 0.50% with oxygen and lime to form a slag and removal of the slag is improved by introducing at least a part of the required amount of lime as lime powder, together with oxygen, by injection tuyeres under the surface of the melt using tuyeres consisting of concentric pipes wherein the oxygen is surrounded by hydrocarbons. This improvement reduces to a maximum of two, the slag changes required to reduce the sulfur content to 0.05% or lower.

8 Claims, No Drawings

PROCESS FOR THE PRODUCTION OF NICKEL ALLOYS

The invention relates to a process for the production of nickel alloys in a converter, in which process oxygen, surrounded by hydrocarbons, and powdery fluxes are injected through tuyeres consisting of concentric pipes arranged under the bath surface in the refractory lining of the coverter.

Nickel is known to be an important alloying component of stainless steels and special tool steel grades. As alloying material for steel alloys, nickel is mainly used in the form of pure nickel metal or as ferro-nickel with different iron contents.

The alloying nickel materials are produced from the nickel ores existing in nature with different incidental elements, e.g. as nickel magnetopyrite or nickel bound in laterite mainly existing in the form of garnierite.

Usually these ores from natural sources are melted, in a first stage of metallurgical treatment, e.g. in an electric low shaft furnace, to a so-called ferro-nickel crude metal.

The ferro-nickel crude metal consists substantially of ferro-nickel with varying nickel contents between approximately 5 to approximately 30%. Further incidental elements are silicon 0.01 to 4%, carbon 0.01 to 2.5%, sulfur 0.02 to 0.05%, phosphorus 0.01 to 0.30%. The rest is iron. Whereas iron and silicon as incidental elements of ferro-nickel do generally not disturb the production of nickel-alloy steels, the contents of phosphorus, however, and particularly of sulfur are not desired.

For these reasons it is indispensable for production of a commercial ferro-nickel as an alloying element, to remove to a great extent the undesired incidental elements sulfur and phosphorus from the ferro-nickel crude metal. The iron contents in the ferro-nickel alloys have different values, dependent on the use of these alloying materials. For example, a high iron content is desired for the use of ferro-nickel alloys for the production of stainless steels. The iron contents for these ferro-nickel alloys are between approx. 50 to approx. 85%.

A way mainly used today for the elimination of the incidental elements sulfur, phosphorus, and carbon from the ferro-nickel crude metal, consists in slagging these undesired incidental elements in an oxygen top-blowing converter. This process necessitates, however, due to the usually high sulfur contents of more than 1.0% a change of slag several times. For example, with an initial sulfur content in the ferro-nickel crude metal of 0.24%, it is necessary to change the slag more than three times, in order to attain a final sulfur content of approx. 0.04%, which provides a commercial ferro-nickel alloy. During these frequent changes of slag, the sulfur content in the ferronickel crude metal is reduced with relatively high lime rates of aprox. 140 kg/t, to approx. 0.2% after the first change of slag; after the second change of slag the sulfur content is reduced to approx. 0.15%, after the third change of slag the sulfur content is about 0.10%, and only after the sixth change of slag, the sulfur value attains approx. 0.04%. During the accomplishment of these six changes of slag, the nickel content in the melt is increased from approx. 15% to aprox. 30%.

The frequent renewal of the slag by lump lime has unfavorable effects on the heat balance of this refining process. With the ferro-nickel crude metal containing carbon and silicon, the heat in the first step is preferably produced by slagging the incidental elements of the ferro-nickel, silicon and carbon, whereas in the two following steps the heat is exclusively produced by slagging the iron.

It is the object of the invention to provide a process, which assures an adjusted, safe removal of incidental elments, particularly sulfur, from the ferro-nickel crude metal with a maximum of two slag changes enabling a high iron yield.

This object can be solved in such a way that, starting from a liquid ferro-nickel crude metal with a sulfur content of approx. 0.10% to approx. 0.50%, preferably 0.20%, with a maximum of two changes of slag in the same converter, at least a partial quantity of the required lime as lime powder, together with the oxygen, is introduced by injection tuyeres under the bath surface and nickel alloys, mainly ferro-nickel or stainless steel, with a sulfur content of maximum 0.05% are produced. This high degree of desulfurization, typical for the inventive process, is also achieved at a simultaneously high iron yield. This is of particular importance for the production of nickel-alloy stainless steels in one heat in the same converter, starting from the mentioned crude ferro-nickel. In applying the process according to the invention, the low sulfur content of 0.05% can already be achieved at an iron yield of at least 75%.

It has been surprising to ascertain that the desulfurization of the ferro-nickel crude metal by lime powder passing through the melt, is considerably more intensive than by the addition of lump lime on the melt. The results of desulfurization during trial- and production heats proved a sulfur reduction in the ferro-nickel crude metal, by addition of lime powder through the tuyeres under the bath surfaces, of approximately twice as high as by addition of lump lime on the melt, related to the introduced lime amount, and, of cource, in approximately the same range of the absolute sulfur contents in the melt. The advantages of the lime powder addition through the tuyeres mainly became obvious in adjusting low sulfur contents. For example, in a 10-t converter, sulfur contents of approx. 0.05% could be attained relatively easily with lump lime, but the desired low contents under 0.02% could only be attained by addition of lime powder.

One object of the invention is a process for the production of nickel alloys in a converter, in which process oxygen, surrounded by hydrocarbons, and powdery fluxes are introduced through tuyeres consisting of concentric pipes arranged under the bath surface, characterized in that the lime for formation of slag is partly charged into the converter as lump lime and/or coarse grain lime and preheated there prior to charging the ferro-nickel crude metal. Apart from or instead of the fluxes, iron scrap can also be preheated in the same way. On the one hand the accumulated heat of the hot converter lining can be used for preheating, on the other hand heating is preferably accomplished through the tuyeres in the converter with hydrocarbons and oxygen in approximately stoichiometric ratio.

The preheated lime is, apart from the improvement of the heat balance, of particular advantage from a metallurgical standpoint. Mainly the desulfurization of the ferro-nickel crude metal melt is improved by the preheated lump lime respectively coarse grain lime. For example, by preheating the lump lime to approximately 1000° C. and a minor loading of the oxygen with lime powder (quantity of lime powder approx. 1/5 to ⅓ relating to the lump lime) the melt could safely be desulfurized from an initial sulfur content of approx. 0.4% to a value under 0.1%, for example 0.06%, during the first refining phase, until the first change of slag.

A further object of the invention is a process for the production of nickel-alloy stainless steels, characterized in that the desired stainless steel grade is produced, including all necessary partial steps in one heat in one converter. Surprisingly it has proved advantageous in operating practice to perform all partial steps in the same converter, starting from the production of a ferro-nickel melt, the addition of alloying ferro-chrome, the decarburization, including the precision decarburization using oxygen with the addition of argon and the usual reduction of chrome from the slag.

In this sequence of production of stainless steels, the addition of ferro-chrome to the decarburized ferro-nickel melt has shown to be no problem. The ferro-chrome dissolved unexpectedly well in this melt, which is very probably due to the intensive bath agitation by introduction of oxygen, surrounded by hydrocarbons, under the bath surface. With the enrichment of the oxygen by argon, up to argon contents in the range of 96%, final carbon contents of 0.01% in the melt could be realized without additional measures and without unusually high losses of chrome.

The process for production of stainless steels according to the invention makes it possible, in one converter processing without intermediate cooling, i.e. under saving of considerable energy expenses, to produce nickel-alloy stainless steel of any usual analysis directly from the ferro-nickel crude metal. The advantages of this method are obvious, amongst others, considerable expenses can be avoided by saving energy. For example, it is possible without difficulties to produce with one change of slag, after adjustment of sulfur contents under 0.04% in the ferro-nickel melt, directly by adding alloying ferro-chrome and iron scrap, a stainless steel with the composition of 18% chrome and 8% nickel, the rest mainly iron. For refining the ferro-nickel melt to stainless steel, particularly with chrome as an alloying element, it has proved suitable to add in a known way to the oxygen an inert gas, for example argon and/or nitrogen, to reduce the oxygen partial pressure. In this way of operation, the inert gas rates are constantly increased towards the end of refining, so that in the last minute of refining pure argon is blown. This reblowing with pure argon has apart from the good purging effect, which, amongst others, leads to low hydrogen contents, also the desired effect of the almost complete concentration balance between metal melt and slag. For example, the oxidation potential of the slag is thus nearly completely utilized for reducing the carbon concentration in the metal melt.

It is within the scope of the invention presented herein to produce ferro-nickel alloys with very low contents of undesired incidental elements, particularly of sulfur and phophorus. Furthermore it is within the scope of the invention to refine the finished ferro-nickel alloy directly in the same converter by addition of respective alloying elements finally to a stainless steel of desired composition.

The process according to the invention will now be explained in detail in non-restrictive examples.

EXAMPLE 1

In a converter with a capacity of 10 tons corresponding to an interior converter volume of approx. 3 $m^3$, five tuyeres, each consisting of two concentric pipes, have been arranged in the bottom. The inside diameter of the central pipe for the oxygen supply respectively oxygen/lime powder suspension was 12 mm, the wall thickness 4 mm. The second concentrically located pipe had interior ribs as distance pieces and an inside diameter of 22 mm, so that an annular slot of approx. 1 mm for the supply of the protective medium was formed.

Into this converter, at first 400 kg of lump lime were charged and preheated to approx. 1000° C. The heating was accomplished by the described tuyeres in about 15 min. In this time, 15 $Nm^3/h$ propane flowed through the annular slot and 75 $Nm^3/h$ oxygen through the central pipe. Subsequently 5.5 t of liquid ferro-nickel crude metal with a temperature of approx. 1380° C. and a composition of Ni 10.1%, P 0.03%, S 0.36%, C<0.01% were charged.

The first refining phase lasted approx. 12 min. 150 $Nm^3$ oxygen and 5 $Nm^3$ propane as protective agent were introduced. After this first refining phase, removal of the liquid slag was accomplished, which had the following composition: CaO 25%, MgO 6%, FeO+-$Fe_2O_3$48%, NiO 0.2%, S 0.32%.

At that time the ferro-nickel melt had an analysis of Ni 13.1%, S 0.88% and a temperature of about 1500° C. After this one change of slag, 110 $Nm^3$ $O_2$ loaded with approx. 300 kg lime powder and approx. 3.5 $Nm^3$ $C_3H_8$ were injected in about 8 min. Subsequently the finished ferro-nickel melt had a composition of Fe 83.6%, Ni 16.5%, S 0.04% and a temperature of 1620° C. The heat was tapped and cast in 40 kg molds. The material came on the market in this form as alloying material ferro-nickel.

EXAMPLE 2

In another heat, at first 1000 kg of iron scrap and 300 kg of lump lime were preheated in a converter with a volume of approx. 5 $m^3$. Subsequently 5.5 t of ferro-nickel crude metal with a composition of Ni approx. 13.6%, S approx. 0.25%, temperature approx. 1450° C. were charged. After one change of slag and a total refining time of about 16 min, in which 230 $Nm^3$ oxygen and 11 $Nm^3$ propane as well as 300 kg of lime powder were added, the ferro-nickel melt had an analysis of 12.8% Ni, 0.045% S and a temperature of approx. 1650° C. Into this melt, 2500 kg of ferro-chrome were charged. After a further blowing period of 18 min, in which 240 $Nm^3O_2$ and 12 $Nm^3$ $C_3H_8$ flowed through the tuyeres, the steel analysis was as follows: 0.44% C, 10.5% Ni, 17.0% Cr, 0.045% S, temperature 1690° C. In the next phase of 12 min, the oxygen was enriched with argon, in the beginning in a ratio of 1:1 up to a ratio of 1:20. Within the last two blowing minutes, argon flowed through the annular slot of the tuyeres, as well as through the central pipe. In the next phase, 150 kg of aluminum were added, and with the argon 250 kg of lime powder were injected.

The melt had a final composition of 70.6% Fe, 18.4% Cr, 11% Ni, 0.007% C and a temperature at tapping of 1600° C. The slag had a composition of 45% CaO, 8% FeO, 4% $Cr_2O_3$, 10%MgO, 15%$Al_2O_3$, 7%$SiO_2$, 0.07% S. This heat was cast as usual and processed as stainless steel grade.

It is within the scope of the invention to vary the single process operations within the usual range. The substantial concept of the invention, however, namely the use of a converter with oxygen injection tuyeres under the bath surface and the at least partial use of lime powder and a change of slag of a maximum of twice, are being maintained for the production of ferro-nickel. Stainless steel grades can, starting from ferro-nickel crude metal, be produced in one heat and in the same converter.

We claim:

1. In a process for the production of a nickel alloy having a maximum sulfur content of 0.05% in a converter, by treatment of a crude ferro-nickel melt having a sulfur content of about 10% to about 0.50% with oxygen and lime to form a slag and removal of the slag, the improvement which comprises introducing at least a part of the required amount of lime as lime powder, together with the oxygen, by injection tuyeres under the surface of the melt using tuyeres consisting of concentric pipes wherein the oxygen is surrounded by hydrocarbons, and wherein the lime for formation of slag is partly charged into the converter as lump lime or coarse grain lime ad preheated there prior to charging the ferro-nickel crude metal, whereby a maximum of two slag formation and removal treatments is required to obtain said maximum sulfur content.

2. The process according to claim 1, further comprising preheating scrap iron with the lime in the converter prior to charging the ferro-nickel crude metal.

3. The process according to claims 1 or 2, further comprising finally refining the ferro-nickel melt, after removal of the slag to stainless steel in the same heat, with the optional addition of further alloying elements.

4. The process according to claim 1 or 2 wherein the ratio of the lime powder to the lump or coarse lime is 1/5 to ⅓ and the preheating temperature is 1000° C.

5. The process according to claim 1 or 2 wherein the preheating is accomplished by accumulated heat of the hot converter lining or by the tuyeres injecting hydrocarbons and oxygen in stoichiometric ratio.

6. The process according to claim 3, wherein, towards the end of refining, an inert gas is added to the oxygen.

7. The process according to claim 3, wherein the ferro-nickel melt is alloyed with ferro-chrome.

8. The process according to claim 6 wherein the inert gas is selected from the group consisting of argon and nitrogen.

* * * * *